US005524816A

United States Patent [19]

Zriny

[11] Patent Number: 5,524,816

[45] Date of Patent: Jun. 11, 1996

[54] TRIFOLD LID STORAGE BOX AND STORAGE SYSTEM

[75] Inventor: Robert A. Zriny, South Brunswick, N.J.

[73] Assignee: Whitney Corr-Pak International, Inc., E. Brunswick, N.J.

[21] Appl. No.: 514,231

[22] Filed: Aug. 11, 1995

[51] Int. Cl.[6] ..... B65D 5/66; B65D 5/68; A47C 21/00

[52] U.S. Cl. ..... 229/125; 5/503.1; 229/125.28; 229/131; 229/178

[58] Field of Search ..... 229/117.23, 117.24, 229/125, 125.06, 125.08, 125.28, 130, 131, 178, 179; 5/503.1, 658, 924

[56] References Cited

U.S. PATENT DOCUMENTS

| | | | |
|---|---|---|---|
| 414,538 | 11/1889 | Hoen . | |
| 466,479 | 1/1892 | Winchester . | |
| 764,414 | 7/1904 | Benz | 5/503.1 |
| 1,149,891 | 8/1915 | Billstein | 229/125 |
| 1,325,041 | 12/1919 | Phelps . | |
| 1,853,219 | 4/1932 | Newton | 229/131 |
| 1,895,070 | 1/1933 | Czerweny . | |
| 1,974,552 | 9/1934 | Wallbank | 229/131 |
| 2,300,491 | 11/1942 | Ferguson | 229/178 |
| 2,801,785 | 8/1957 | Manizza | 229/131 |
| 2,885,140 | 5/1959 | Guyer | 229/131 |
| 3,567,106 | 3/1971 | Anderson | 229/131 |
| 4,278,196 | 7/1981 | Ford | 229/198.1 |
| 5,029,709 | 7/1991 | Faulstick . | |
| 5,095,566 | 3/1992 | Russell | 5/503.1 |
| 5,398,868 | 3/1995 | Densen | 229/125.28 |

FOREIGN PATENT DOCUMENTS

| | | | |
|---|---|---|---|
| 173050 | 12/1921 | United Kingdom | 5/503.1 |
| 3488839 | 5/1931 | United Kingdom | 229/131 |
| 490538 | 8/1938 | United Kingdom | 229/131 |
| 751638 | 7/1956 | United Kingdom | 229/125.28 |

*Primary Examiner*—Gary E. Elkins
*Attorney, Agent, or Firm*—Middleton & Reutlinger; John F. Salazar

[57] ABSTRACT

A tri-fold lid storage box which enables the user to convert available storage space underneath a bed into usable storage. The storage box is comprised of a separate box and lid, the box having a triple reinforced front panel for pulling the box outward, the lid having a specially designed lid which can fold back either ⅓, ⅔ or be completely removed. The lid is also removably attached to the storage box and is specially designed so the user may lock the lid into the ⅔ open position so that the user can view and manipulate the contents of the box without having to hold the lid open. The boxes are specially dimensioned so that they fully utilize the storage space available underneath a standard size bed.

17 Claims, 8 Drawing Sheets

TRIFOLD LID STORAGE BOX AND STORAGE SYSTEM

BACKGROUND OF THE INVENTION

1. Field of the Invention

The present invention relates generally to storage boxes and packaging and particularly to a storage box which has a specially designed lid and proper dimension for creating a storage area underneath a bed wherein the space is fully utilized as well as allowing the user to see the contents of the box using incremental opening of the lid.

2. Description of the Prior Art

Storage boxes wherein a rectangular lower section and separate lid are well known. Contents are stored in the interior of the lower section and sealed within by placing a lid matching the lower sections dimensions over the top.

U.S. Pat. No. 1,895,070 discloses a cardboard box and the like wherein a single piece box design is shown, said single piece box design has a top portion which may hinge upward and which always leaves a portion of the box contents covered.

U.S. Pat. No. 5,029,709 discloses a package for storing a rectangular article wherein a single piece box design is utilized to protect the contents thereof and allows for the opening of the lid along a single hinge line.

Many prior art storage boxes are available which allow the user to store things within but which do not allow for the easy retrieval of the contents therein. The known storage boxes also do not provide a method for incremental opening the lid of the storage box or for providing a system of boxes of predefined size which utilize the full available space underneath a typical bed.

SUMMARY OF THE INVENTION

The present invention discloses a special storage box design which allows the user to fully utilize the area located underneath a bed while also allowing the user to view the contents of the storage box while incremental removing the lid. The box system is specially designed for use underneath a bed and provides a system for fully utilizing the entire available storage area underneath a bed while also allowing the user to incremental open the lid of the storage box so that the contents may be viewed either partially or in their entirety.

More particularly, the present invention is comprised of a lower rectangular storage box and a separate storage box lid wherein the lower storage box has a triple reinforced from face which retains a removable handle. The storage box lid is specially designed so that it may be removably attached to the lower storage box at one end and also has the ability to be opened and secured in the open position while the remainder of the lid stays in place. The storage box lid has two perforation lines along its top surface which allow the lid to be moved back and away displaying either ⅓ contents of the lower storage box or ⅔ contents.

Even more particularly, the present invention discloses a two piece storage box comprised of a lower rectangular storage box having a center panel, a front wall, an opposing rear wall, and a first and second opposing side wall; wherein said front wall is formed from an interior and exterior front panel and a first and a second front panel tuck flap, said first and second front panel tuck flap inserted between said interior and an exterior front panel, said interior and said exterior front panel having at least one aperture located therethrough for inserting a removable handle; a storage box lid having a lid front panel, a lid center panel, and a lid rear panel, a front panel score line interposed between said lid front panel and said lid center panel, and a rear panel score lid interposed between said lid center panel and said lid rear panel; wherein said lid front panel is foldable about said front panel score line and said lid center panel is foldable about said rear panel score line; means for retaining said front panel and said center panel in a back to back vertical relationship with respect to said rear panel; means for removably affixing said storage box lid to said lower rectangular storage box.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
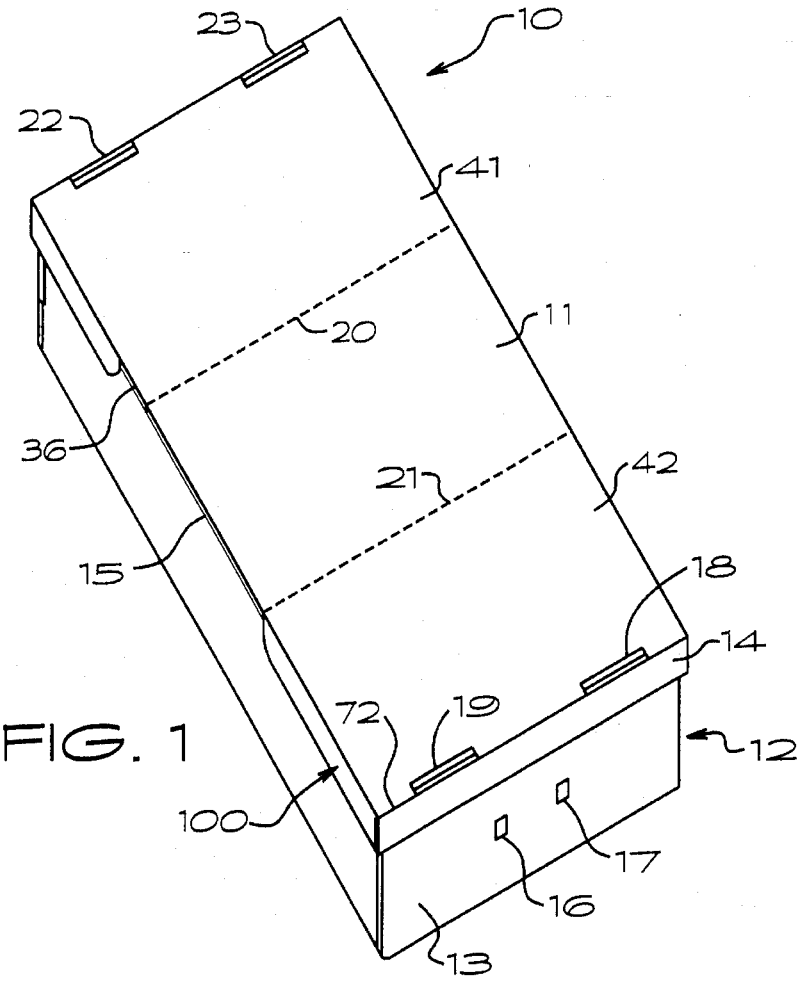
FIG. 1 is a top perspective view of a storage box utilizing this novel design.

Referring now to the figures, FIG. 1 shows the assembled storage box 10 of the present invention. The storage box 10 is defined by storage box lid 100 and lower storage box portion 12, both of which are rectangular in shape. The lid is shown in cutout blank form in FIG. 6 and the lower storage box portion 12 is shown in cutout blank form in FIG. 7.

Figure 7:
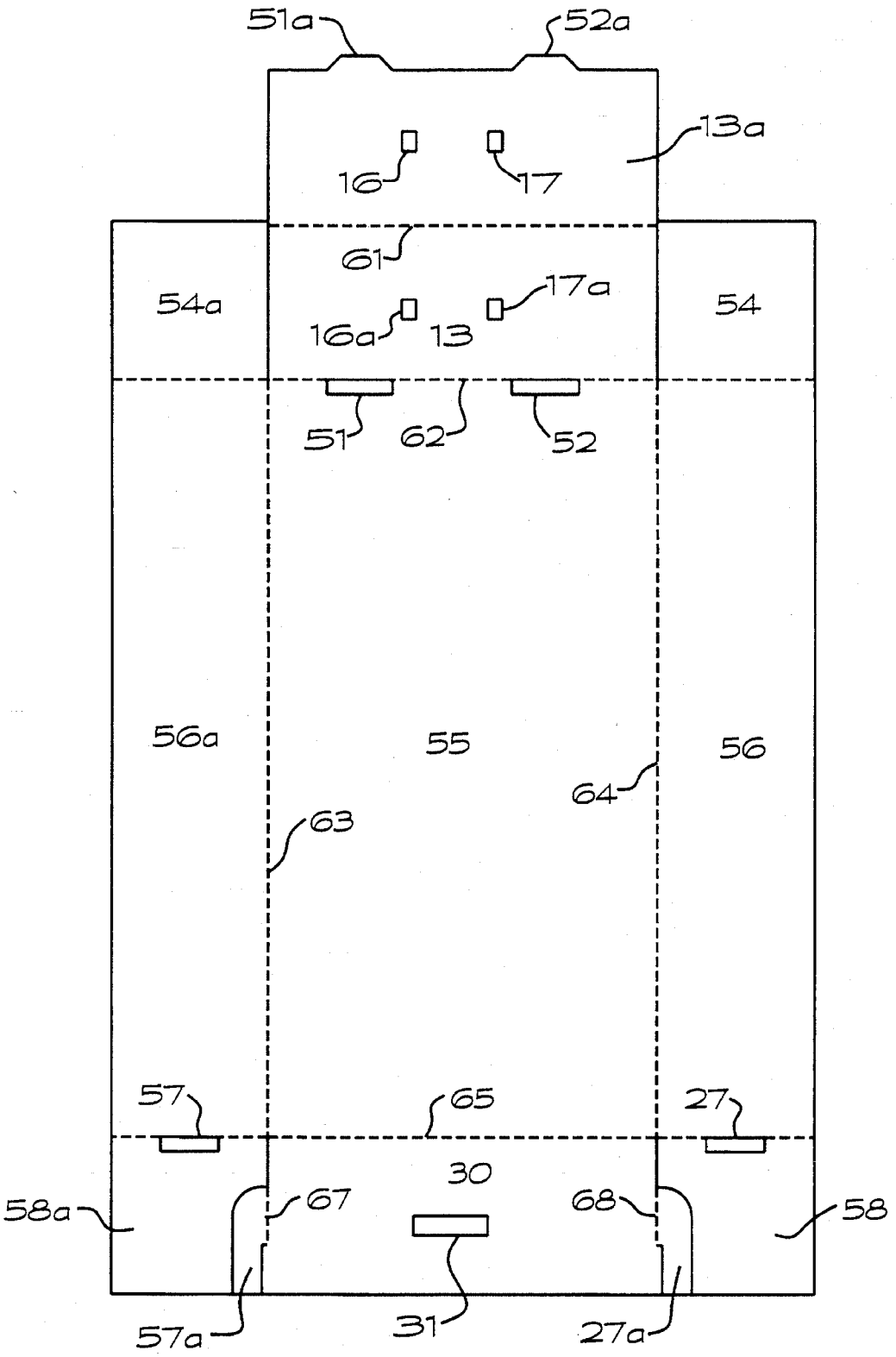

The lower storage box portion blank, as shown in FIG. 7, is defined by the following:

rectangular lower box center panel 55 which is bounded by a front face edge score line 62, a first side panel score line 63, a second side panel score line 64 and a rear face edge score line 65 which allows the front, side, and rear panels of the lower storage box to be folded upwards at a 90 degree angle with respect to center panel 55;

lower box exterior front panel 13 and interior front panel **13*a* which are divided by front panel score line 61 providing for a double reinforced front panel which has handle apertures 16, 16*a*, 17, and 17*a***;

a first and a second front panel tab 51*a* and 52*a* formed along the topmost edge of the interior front panel 13*a* for inserting into first and second front panel slots 51 and 52 so that both exterior front panel 13 and interior front panel 13*a* are back to back in a vertical relationship with respect to said center panel 55;

first and second rectangular front panel tuck flaps 54 and 54*a* which are formed along from face edge score line 62 and which are inserted between exterior front panel 13 and interior front panel 13*a* when they are in the back to back vertical relationship described above;

first and second, rectangular lower box side panels 56*a* and 56 which are formed along first and second side panel score lines 63 and 64 respectively;

lower box rear panel 30 which has formed along each side first and second lower box rear panel tabs 57*a* and 27*a*, each of which bend along first and second rear panel tab score lines 67 and 68, and lower box rear panel anchor slot 31 which receives a lid anchor tab; and, first and second lower box rear panel tuck flaps 58*a* and 58 which form approximately a 90 degree box corner along rear face edge score line 65 and score lines 63 and 64 and which have rear first and second rear panel slots 57 and 27 for receiving first and second rear panel tabs 57*a* and 27*a*.

Figure 6:
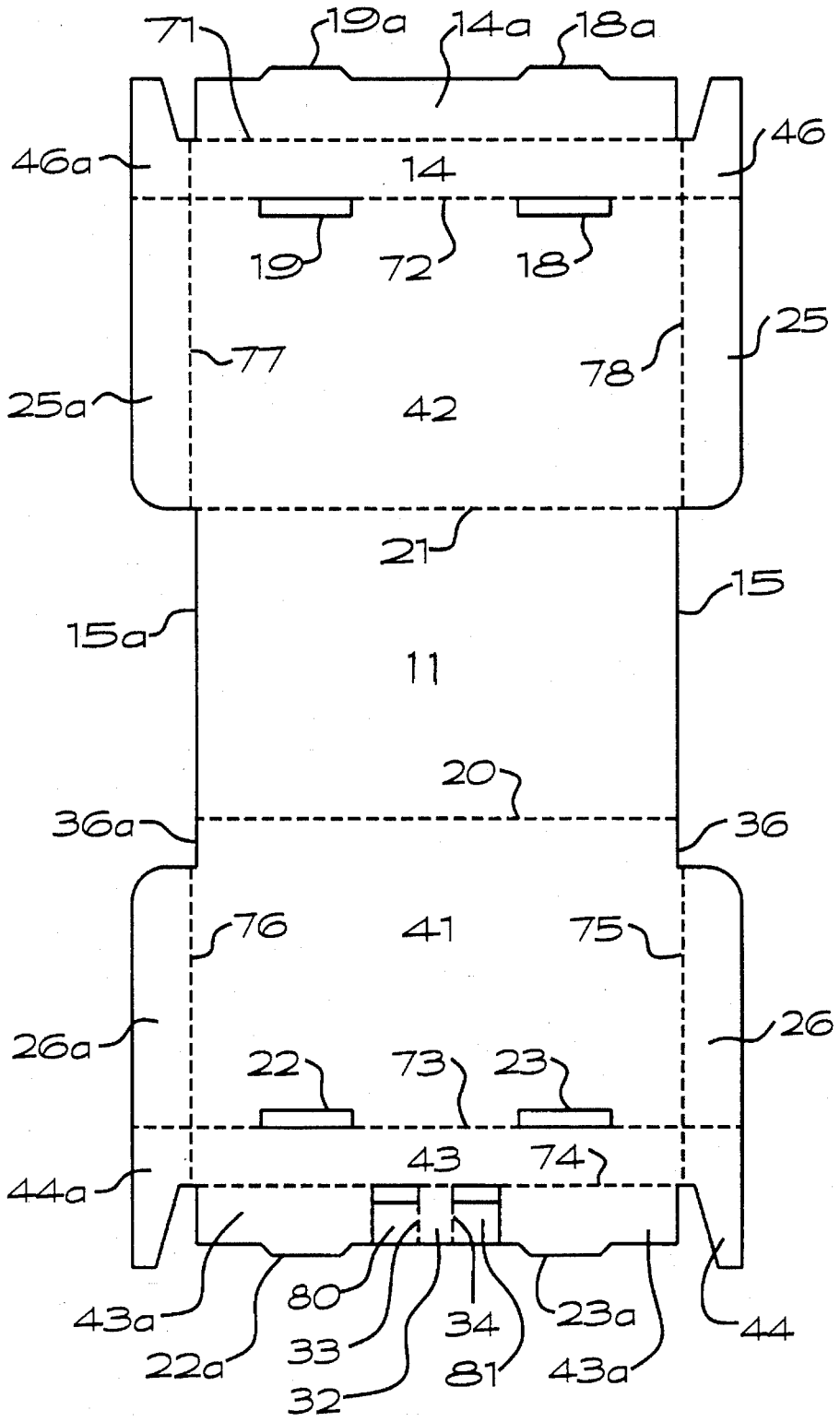
FIG. 6 is a top plan view of the cutout paperboard blank from which the storage box lid is formed; and, FIG. 7 is a top plan view of the cutout paperboard blank from which the lower storage box portion is formed.

The storage box lid, as shown in FIG. 6, is generally defined by:

three rectangular panels, lid front panel 42, lid center panel 11 and lid rear panel 41;

first and second downwardly extending front panel side members 25*a* and 25 which fold about first front panel side edge score line 77 and second from panel side edge score line 78;

first and second front panel tuck flaps 46*a* and 46 which insert between lid interior panel front face 14*a* and lid exterior front panel face 14 when said faces are folded about front panel lower edge score line 71 thereby forming a first and second front panel lid corner from the perpendicular edges of downwardly extending from panel side members 25*a* and 25 and downwardly extending front panel face 14.

first and second lid front panel tabs 19*a* and 18*a* which are formed along one longitudinal edge of interior lid front panel 14*a* and which fit into first and second from panel slots 19 and 18;

center panel 11 bounded on opposing lateral sides by first and second center panel edges 15*a* and 15 and on opposing longitudinal edges by score lines 21 and 20;

lid rear panel 41 which has first and second frontal edge members 36*a* and 36 and first and second lid rear panel side members 26*a* and 26 which fold along first rear panel score line 76 and second rear panel score line 75 respectively to form downwardly extending side members;

lid exterior rear panel face 43 and interior rear panel face 43*a* which have extending therefrom first lid rear panel tab 22*a* and second rear panel tab 23*a*, said interior and exterior panel face members 43*a* and 43 fold along rear panel lower score line 74 so that panels 43 and 43*a* lie back to back in vertical relationship with respect to said lid rear panel 41;

first and second lid rear panel tuck flaps 44*a* and 44 which fold along rear panel upper edge score line 73 and which fold in between lid exterior rear panel face 43 and interior rear panel face 43*a* when they are in said defined vertical relationship; and, lid panel anchor tab 32 which has first and second anchor tab flaps 80 and 81 which fold along first and second anchor tab score lines 33 and 34.

Detailing the lower storage box portion 12, FIG. 1 shows the assembled storage box 10 wherein lower storage box portion 12 has a lower storage box vertically extending exterior front panel 13 which has located therein two apertures 16 and 17 which create the lower storage box front panel handle apertures. The apertures which are shown herein may also be replace by a single aperture which acts as an opening to insert a hand into thereby performing the same function as an inserted handle. The front panel handle apertures receive a removable handle which may be inserted therein. The exterior front panel 13 is better shown in FIG. 7 wherein the double reinforced portion, interior front panel 13*a* can also be seen. This design allows for the lower box exterior front panel 13 to be reinforced by interior front panel 13*a* which is folded along front panel score line 61. Front panel score line 61 thus becomes the topmost edge of the front panel of the lower storage box portion. The design for the front portion of the lower storage box front panel additionally provides for triple reinforcement provided by exterior and interior front panel 13 and 13*a* and lower box first and second front panel tuck flaps 54*a* and 54. First and second tuck flaps 54*a* and 54 do not extend the entire length along the front face providing access to handle apertures 16, 16*a*, 17 and 17*a*.

Figure 9:
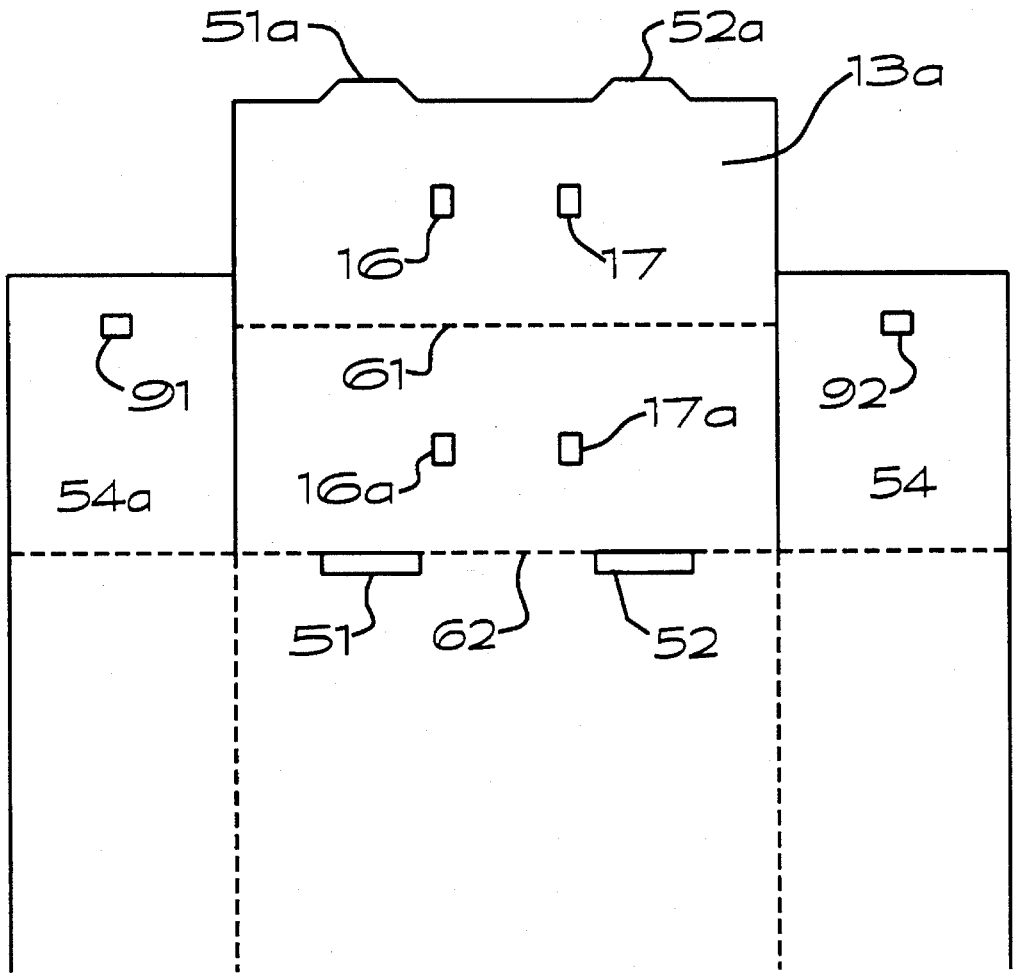
FIG. 9 is top plan view of an alternative embodiment for providing true triple layered thickness across the front panel handle area.

Alternatively, as shown in FIG. 9, additional triple reinforcement protection can be provided by designing first and second front panel tuck flaps 54*a* and 54 to extend inwards farther than shown in FIG. 7. This design allows for the panel tuck flaps to also have handler apertures 91 and 92, as shown in the drawings. With this design, the handle extends through interior front panel 13*a*, exterior front panel 13 and first and second front panel tuck flaps 54*a* and 54. This ensures that the are which receives the most stress due to overuse, that being the handle and handle support locations, will be reinforced to a maximum of three layers thereby preventing the area from becoming torn alter repeated use.

Along storage box interior front panel 13*a* longitudinal edge line opposite the front panel score line 61 are located lower box first and second front panel tabs 51*a* and 52*a* which provide a means for securing the folded interior front panel 13*a* within the interior of the storage box. First panel tab 51*a* snaps into lower box first front panel slot 51 while second panel tab 52*a* snaps into lower box second front panel slot 52 after the first and second tuck flaps 54*a* and 54 have been folded between interior and exterior front panels 13 and 13*a*. The tab/slot combinations allow for easy assembly of the front face portion of the storage box while also allowing the box to be disassembled with relative simplicity.

Figure 10:
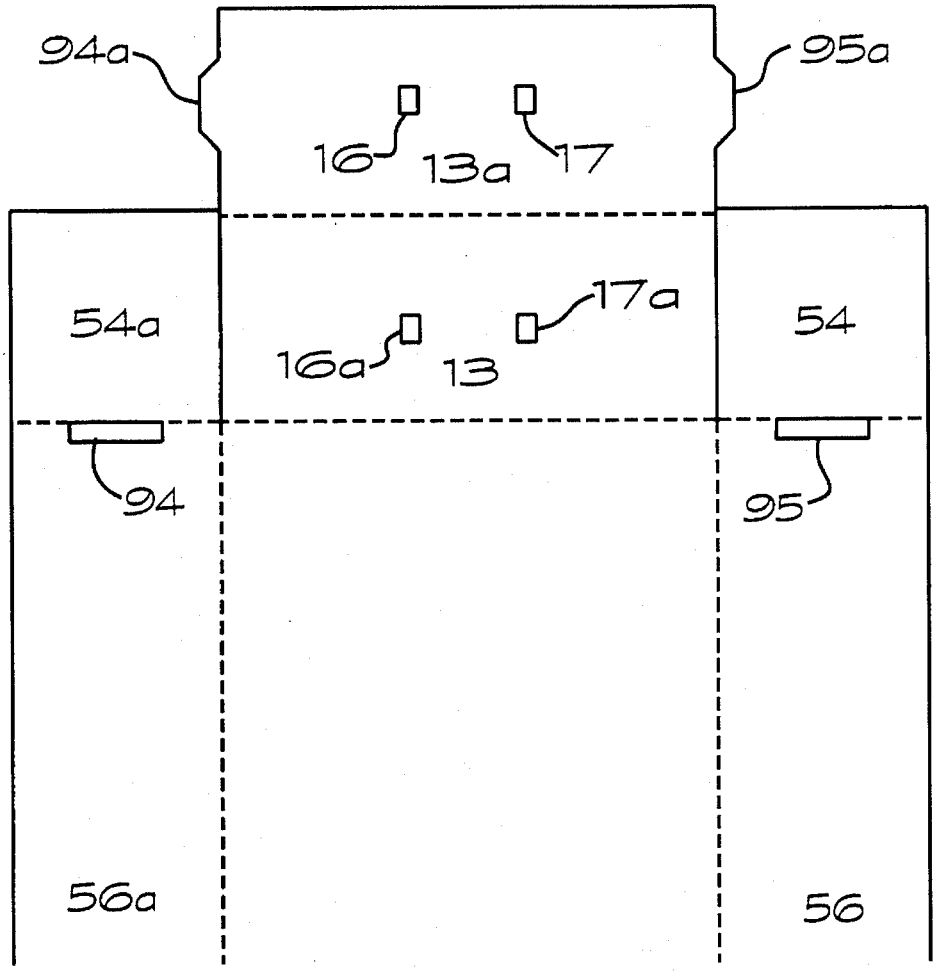
FIG. 10 is a top plan view of an alternative embodiment of the front panel area when a shorter interior front panel is required.

As shown in FIG. 10, an alternative design is displayed for use when interior front face panel 13*a* must be shorter and not extend downward reaching center panel 55. This situation arises particularly for packing and shipping unassembled boxes. In such a situation, front panel tabs 94*a* and 52*a* can be located along the lateral edges of interior front face panel 13*a*, as is shown in FIG. 10. In this arrangement, slots 51 and 52 are then placed along first and second side panels 56*a* and 56.

The main portion of the lower storage box is lower box center panel 55 which has adjacent and vertically extending first and second side panels 56*a* and 56 which fold along first side panel score line 63 and second side panel score line 64 respectively. Vertically extending rear panel 30 folds along rear face edge score line 65 wherein first and second rear panel tuck flaps 58*a* and 58 are held interior to the storage box. First and second rear panel tuck flaps 58*a* and 58 also have lower box first and second rear panel slots 57 and 27 which receive lower box first and second rear panel tabs 57*a* and 27*a*. Tabs 27*a* and 57*a* fold along second rear panel tab score line score line 68 and first rear panel tab score line 67 respectively so that the entire tab may be inserted through slots 27 and 57 after folding and then expanded to full size after insertion through the respective slots in order to secure the rear panel 30 in position.

Figure 3:
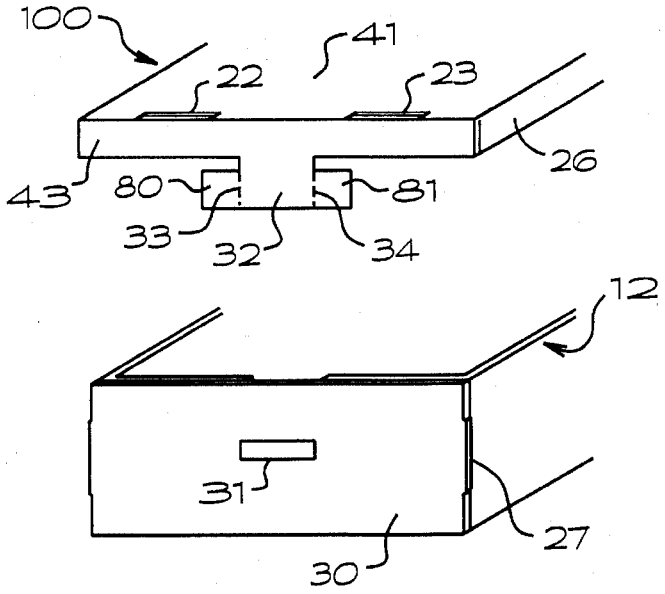
FIG. 3 is an rear end view of the lower storage box portion and separate lid portion.

The vertically extending rear panel 30 also has formed thereon a rear panel anchor slot which receives lid anchor tab 32 shown in FIG. 3. This lid anchor tab and slot combination provides a means for removably affixing the lid to the storage box and allows for the lid 11 to be properly secured onto the top of the lower storage box 12 while being manipulated by the user to view the contents of storage box interior, as will be further described below.

The storage box lid is specially designed so as to allow for securing said storage box lid onto said lower storage box while enabling the user to open the lid in differing amounts so that the user can examine the contents of the storage box interior. As shown in FIG. 1, the storage box lid is defined by a lid center panel 11, lid front panel 42 and lid rear panel 41. Each of the upper lid panels are separated by individual score lines front panel score line 21 and rear panel score line 20. The lid front panel 42 and lid center panel 11 are divided by front panel score line 21 while the lid center panel and lid rear panel 41 are divided by lid rear panel score line 20. These two distinct score lines allow the lid to be opened either ⅓ or ⅔ while still having the lid secured to the lower storage box via lid anchor tab 32 which is inserted into lower box rear panel anchor slot 31. Additionally, providing the anchor tab 32 and anchor slot allows the lid to be fully removed from the top of the lower storage box while still holding the lid in place for proper aligned replacement on the top of the lower storage box.

Figure 2:
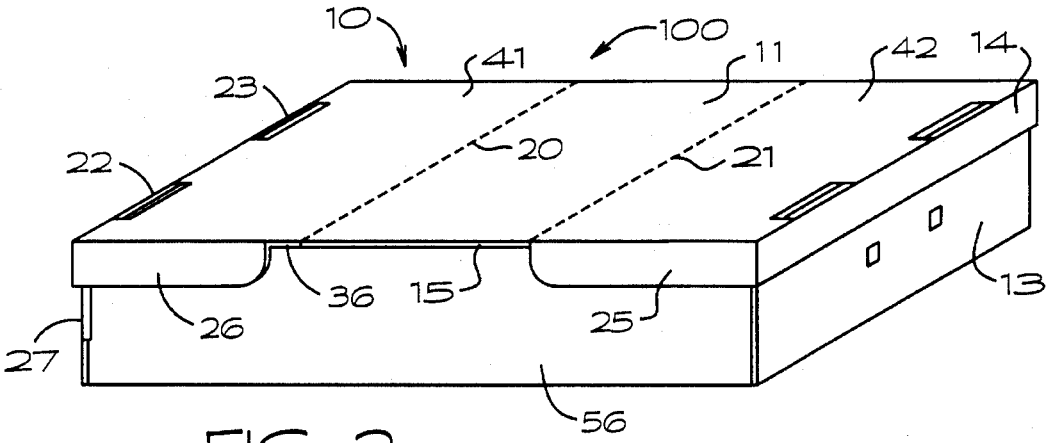
FIG. 2 is a perspective side view of a storage box utilizing this novel design.

As shown in FIG. 1, FIG. 2, and FIG. 6, the lid has center panel 11, front panel 42 and rear panel 41. Lid front panel 42 is defined along one longitudinal edge by exterior lid front panel 14 and the adjacent front panel upper edge score line 72. The front panel is defined along the opposite longitudinal edge by front panel score line 21. The front panel is defined along the lateral edges by first front panel side member 25*a* first front panel side edge score line 77 and along the opposite lateral edge by second front panel side member 25 and adjacent second front panel side edge score line 78.

Interior lid front panel 14*a* has formed thereon first and second front panel tabs 19*a* and 18*a* which fit into first and second front panel slots 19 and 18 when interior lid front panel 14*a* is folded along front panel lower edge score line 71. Front panel upper edge score line 72 forms the exterior score line edge visible in FIG. 1. First and second front panel tuck flaps 46*a* and 46 fit between exterior lid front panel 14 and interior lid front panel 14*a* thereby securing the face 14 and first and second downwardly extending front panel side members 25*a* and 25 in an approximately right angle relationship after panel tabs 18*a* and 19*a* are inserted into panel slots 18 and 19 thereby forming a first and second front panel lid corner.

Figure 4:
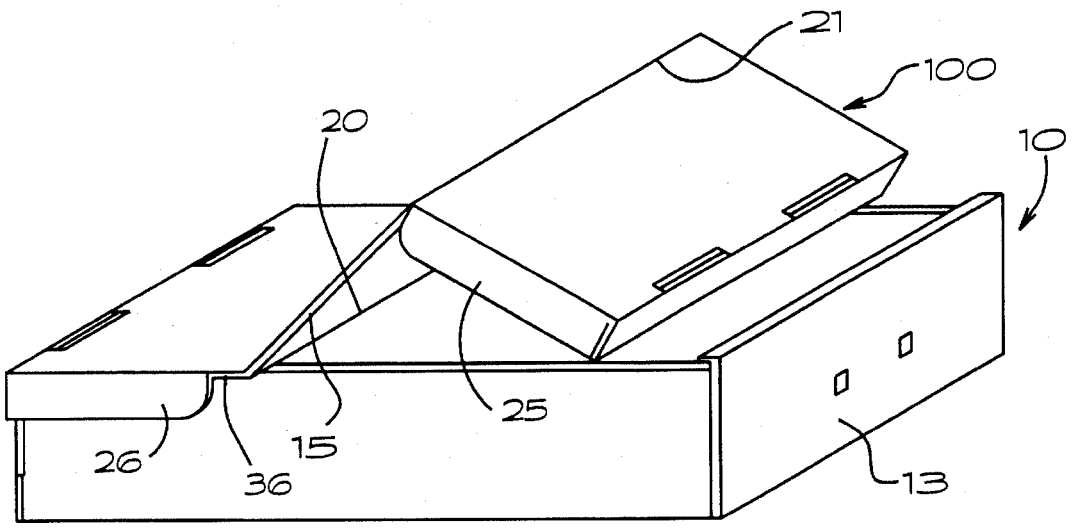
FIG. 4 is a perspective side view of a storage box utilizing this novel design and having the lid partially opened.
Figure 5:
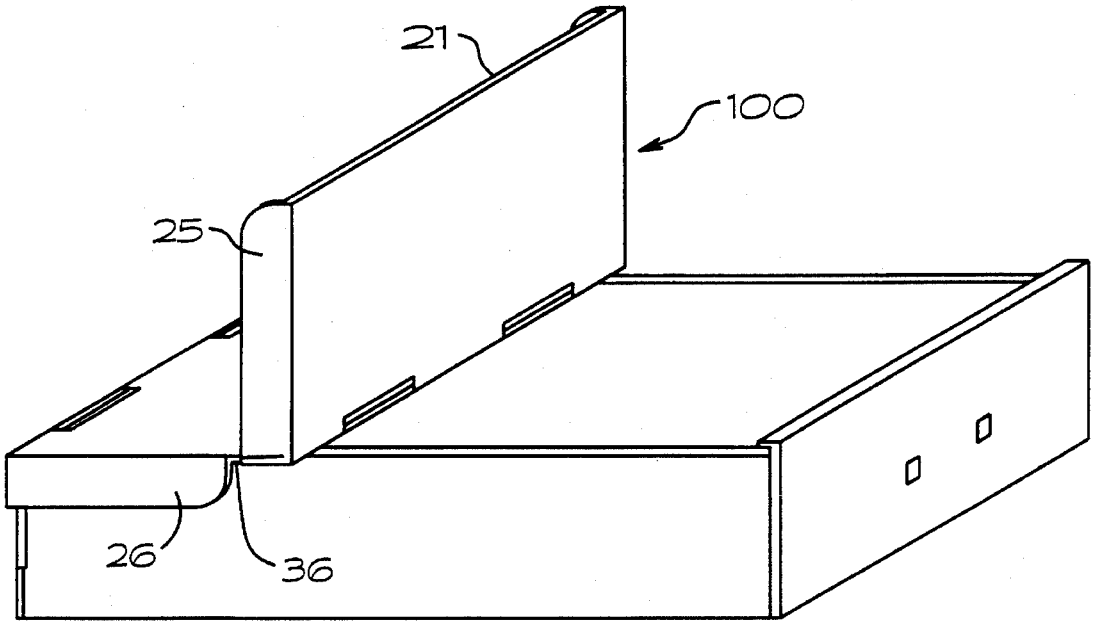
FIG. 5 is a perspective side view of a storage box utilizing this novel design and having the lid ⅔ opened.

Lid center panel 11 is defined on opposing longitudinal edges by score lines 20 and 21 and is bounded on opposing lateral edges by first and second lid center panel edges 15*a* and 15 which do not have a downwardly extending lip member as is located along the front panel in downwardly extending front panel side members 25 and 25*a* and along the rear panel in downwardly extending rear panel side members 26 and 26*a*. The lack of a downwardly extending lip members along both sides of center panel 11 allows the lid to be opened fully along the ⅓ or ⅔ score lines 21 and 20 respectively, as is shown in FIGS. 4 and 5. Providing for no downwardly extending side member along the center panel edges allows first and second front panel side members 25*a* and 25 to swivel about score line 21 and adjacent to first and second lid center panel edges 15*a* and 15 without hindrance. Additionally, the lid is specially designed along the rear panel 41 so that first and second lid rear panel edges 36*a* and 36 provide for the front panel 42 to be locked into the ⅔ open position by sliding lid rear panel edges 36 and 36*a* into the corners formed by the adjoining lid front panel side members 25 and 25*a* and front panel face 14, as is shown in FIG. 5. Thus, one lateral edge of rear panel 41 is defined by a first rear panel edge and a first downwardly extending rear panel side member, said side member not extending the full length of the lateral edge. The opposite lateral edge of rear panel 41 is defined by a second rear panel edge and a second downwardly extending rear panel side member, said second side member not extending the full length of the lateral edge.

Lid rear panel 41 is defined along one longitudinal edge by rear panel score line 20, along the opposite longitudinal edge by rear panel upper edge score line 73, and along lateral edges as described above. First and second downwardly extending rear panel side members 26*a* and 26 do not extend all the way to rear panel score line 20 so that first and second rear panel edges 36*a* and 36 are clearly defined. Also formed on rear panel 41 along rear panel upper edge score line are first and second rear panel slots 22 and 23 for receiving first and second rear panel tabs 22*a* and 23*a* when the rear panel side members 26*a* and 26 are formed adjoining exterior rear panel face 43.

Formed along with downwardly extending first and second rear panel side members 26*a* or 26 and separated by rear panel upper edge score line are first and second lid rear panel tuck flaps 44*a* and 44 for insertion between interior and exterior rear panel face members 43 and 43*a*. These tuck flaps allow the side members and rear panel face member to be joined securely together forming a solid corner joint.

Defined directly below rear panel 41 and along rear panel upper edge score line 73 is exterior rear panel face 43. The exterior rear panel face 43 is defined along one longitudinal edge by score line 73 and along the opposite longitudinal edge by rear panel lower edge score line 74. Below rear panel lower edge score line 74 and forming its uppermost longitudinal edge is interior rear panel face 43*a*. Interior rear panel face 43*a* additionally has first and second lid rear panel tabs 22*a* and 23*a* formed thereon which may be inserted into first and second lid rear panel slots 22 and 23 as was previously described.

Additionally, interior lid rear panel face 43*a* has attached thereto along the longitudinal edge formed by rear panel lower edge score line 74 lid rear panel anchor tab 32 and anchor tab score lines 33 and 34. As is shown in FIG. 3, lid anchor tab 32 has first and second anchor tab score lines 33 and 34 so that lid anchor tab flaps 80 and 81 may be folded over center portion 32 and inserted into anchor tab slot 31. After insertion of the tab into anchor tab slot 31, the flaps 80 and 81 may then be folded outward to their original position so that the lid remains securely attached to the lower storage box portion 12, even while being manipulated by the user.

The lid may be opened to expose ⅓ of the storage box interior by bending lid front panel 42 upward about front panel score line 21. The user can then partially open the box lid and examine the interior without fully removing the storage box lid. In use, if the storage box is placed underneath a bed, the storage box may be pulled forward past the bed rail up to just past score line 21 and the user may then partially open the front panel of the lid as described above so the contents may then be viewed or manipulated. If additional access is required, the storage box may be pulled forward past the bed rail to just past score line 20 allowing the user to more fully expose the contents of the storage box. The storage box lid may be held into place at the ⅔ open position by locking the lid into the ⅔ position as is shown in FIG. 5. The front panel 42 of the lid is rotated about score line 21 as is shown in FIG. 4. At the same time, center panel 11 rotates upward about score line 20. The front panel 42 and center panel 11 are brought into side by side vertical relationship and first and second rear panel edge members 36*a* and 36 are tucked into the first and second front panel lid corners formed by downwardly extending lid front face 14 and perpendicular front panel side members 25 and 25*a*. This configuration is shown in FIG. 5. The features of the lid allowing for the front and center panel to be so secured vertically back to back in an approximately 90 degree relationship with respect to the rear panel provides a means for retaining said front panel and said center panel in a vertical relationship. The locking mechanism thereby allows the user to fully access the contents of the storage box without having to hold the lid in the proper position. The entire lid is also held into place while being manipulated via anchor tab 32 as previously described so that the user may manipulate the lid or have access to the contents of the storage box without the requirement of holding the lid in place with a free hand.

The storage boxes which are the subject of this invention may be made of a variety of materials, those being paperboard, cardboard, plastic, or any of a variety of available materials. The storage boxes can be specially designed to create a storage box system which matches the box size to the dimensions of the specific bed sizes so that two or more, and preferably three, of the storage boxes can fit abreast underneath each side of a bed bringing the total preferable boxes utilized in this system to six. If a bed is placed in a corner of a room leaving only a single side of the bed accessible, only three of the storage boxes may be used in the system. However, by utilizing this special box design and dimensions, maximum use of the space available underneath a bed is accomplished. Each box, therefore, is specially dimensioned to match the dimensions of a standard bed size or the storage area located therebelow. Thus, the storage box length is approximately ½ of the bed width and the storage box width approximately ⅓ the bed length. Creating such a system of boxes matched to specific bed size and storage area available therefore maximizes the utilization of bed size to box ratio.

Figure 8:
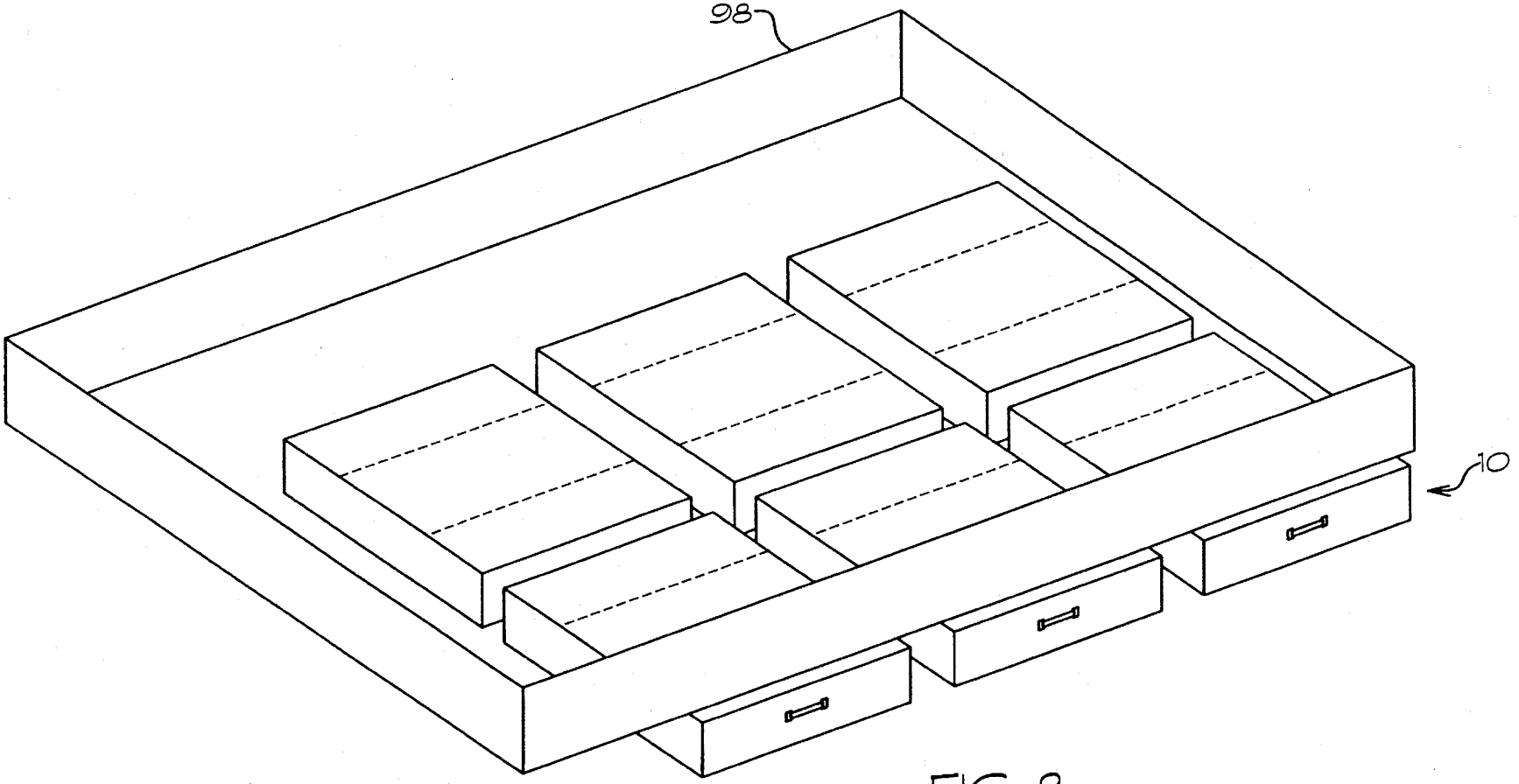
FIG. 8 is a perspective view of the system of boxes as utilized in the storage area underneath a bed.

As shown in FIG. 8, the underside area of a standard bed 98 is shown whereby the storage boxes of the present invention are used. The storage boxes can be sized to maximize storage use underneath standard size beds, those being either King, Queen, or Full. This way, storage boxes targeted for specific size beds can be combined and sold as a set allowing the user to maximize use of that space depending on the size of bed utilized. These sets can combine three of the storage boxes thereby allowing the user to "fill" an entire side of a bed which is accessible if the bed is located in the corner of a room. If the user has a bed which is located in the center of the room, two sets of the boxes may be utilized thereby combining a total of six storage boxes, three abreast on each side, which are then accessible on both sides of the bed.

As previously indicated, the storage boxes of the present invention may be manufactured of either paperboard, cardboard, or plastic. If a plastic material is used, it is unnecessary to provide for all of the tuck flaps and folds which have been described herein for use with the cardboard versions. When using a plastic version, the lid would have creases along the ⅓ and ⅔ portion of the storage box lid allowing the user to bend the lid at the respective locations. Additionally, utilization of plastic may provide for a more durable front handle area that would be less susceptible to tearing or wear after repeated use. In order to provide a means for attaching the lid to the lower storage box portion, a simple tab slot combination without the fold lines described above and required in the cardboard version, can be used. Any methodology may be used as long as the storage box lid is removably attached to lower storage box portion. As plastic is much more malleable, a tab may be provided which is slightly larger than the receptive slot located on the lower storage box rear panel. The tab may then be inserted using slight pressure to force said tab into the undersized slot. The same organization and use of three storage box "sets" may be used in order to utilize the maximum space underneath the bed, that being proper dimensions so that three storage boxes may be located abreast underneath a single bed rail. The combination of the use of the storage boxes of the present invention and underside portion of a bed provides a novel and unique method for fully utilizing the space available.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A two piece storage box comprised of:

a lower rectangular storage box having a center bottom panel, a vertically extending front wall, opposing vertically extending rear wall, and opposing first and second vertically extending side walls;

a storage box lid, said storage box lid having a lid front panel, a lid center panel, and a lid rear panel;

means for removably affixing said storage box lid to said lower rectangular storage box;

means for retaining said lid front panel and said lid center panel in vertical relationship.

2. The two piece storage box of claim 1 wherein said means for removably affixing said storage box lid to said lower rectangular storage box is comprised of:

an anchor slot formed in said lower rectangular storage box which receives an anchor tab extending from storage box lid.

3. The two piece storage box of claim 1 wherein said means for retaining said front panel and said center panel in vertical relationship is comprised of:

a first and a second front panel side member and a lid front panel face, said first and second front panel side members and said front panel face extending downwardly from said lid front panel, said panel side members perpendicular to said lid front panel face and forming a first and second front panel lid corner;

a first and a second lid rear panel edge formed on opposing lateral edges of said lid rear panel, whereby said first and said second lid rear panel edges slidably receive said first and second front panel lid corner.

4. The two piece storage box of claim 1 wherein said front wall of said lower rectangular storage box is formed by an interior front panel, an exterior front panel, and a first and a second front panel tuck flaps.

5. A two piece storage box comprised of:

a lower rectangular storage box having a center panel, a vertically extending front wall and opposing rear wall, and a first and second vertically extending side wall;

wherein said front wall is formed from an interior and an exterior front panel and a first and a second front panel tuck flap, said first and second front panel tuck flap interposed between said interior and said exterior front panel;

a storage box lid having a lid front panel, a lid center panel, and a lid rear panel, a front panel score line interposed between said lid front panel and said lid center panel, and a rear panel score lid interposed between said lid center panel and said lid rear panel;

wherein said lid front panel is foldable about said from panel score line and said lid center panel is foldable about said rear panel score line;

means for retaining said front panel and said center panel in vertical relationship;

means for removably affixing said storage box lid to said lower rectangular storage box.

6. The two piece storage box of claim 5 wherein said means for removably affixing said storage box lid to said lower rectangular storage box is comprised of:

an anchor slot formed in said rear wall;

an anchor tab extending downwardly from said storage box lid;

whereby said anchor slot removably receives said anchor tab.

7. The two piece storage box of claim 5 wherein said means for retaining said front panel and said center panel in vertical relationship is comprised of:

a first and a second front panel side member and a perpendicular lid front panel face, said first and second front panel side members and said front panel face extending downwardly from said lid front panel and forming a first and second front panel lid corner;

a first and a second lid rear panel edge formed on opposing lateral sides of said lid rear panel, whereby said first and said second lid rear panel edges slidably receive said first and second front panel corner.

8. The two piece storage box of claim 5 wherein said interior and said exterior front panel have at least one handle aperture located therethrough.

9. The two piece storage box of claim 5 wherein said first and said second front panel tuck flap, said interior and said exterior front panel each have at least one handle aperture located therethrough.

10. In combination with a bed, a storage box slidable beneath said bed comprising:

a lower rectangular storage box having a center bottom panel, a vertically extending front wall, vertically extending opposing rear wall, and a first and second vertically extending opposing side walls;

a storage box lid, said storage box lid having a lid front panel, a lid center panel, and a lid rear panel;

means for removably affixing said storage box lid to said lower rectangular storage box;

means for retaining said lid front panel and said lid center panel in vertical relationship.

11. The storage box of claim 10 wherein said means for removably affixing said storage box lid to said lower rectangular storage box is comprised of:

an anchor slot formed in said rear wall;

an anchor tab extending downwardly from said storage box lid;

whereby said anchor slot removably receives said anchor tab.

12. The storage box of claim 10 wherein said means for retaining said front panel and said center panel in a vertical relationship is comprised of:

a first and a second front panel side member and a perpendicular lid front panel face, said first and second front panel side members and said front panel face extending downwardly from said lid front panel and forming a first and second front panel lid corner;

a first and a second lid rear panel edge formed on opposing lateral sides of said lid rear panel, whereby said first and said second lid rear panel edges slidably receive said first and second front panel corner.

13. The two piece storage box of claim 10 wherein said front wall of said lower rectangular storage box is formed by an interior front panel, an exterior front panel, and a first and a second front panel tuck flaps.

14. In combination with a bed, said bed having a bed length and a bed width, a preselected number of storage boxes, said preselected number being at least two storage boxes, each of said storage boxes having a box length and a box width, said box length having a value approximately one-half said bed width, said box width having a value approximately said bed length divided by said preselected number, whereby said preselected number of storage boxes are a storage system located on a first side of said bed.

15. The combination of claim 14 wherein said preselected number of storage boxes is three.

16. The combination of claim 14 wherein said storage system is located on a second side of said bed.

17. A two-piece storage box having a lower rectangular storage box and a storage box lid, said lower rectangular storage box comprised of:

an interior front panel defined along one longitudinal edge by a front panel score line, said interior front panel having along an opposite longitudinal edge a first and a second front panel tab, said interior front panel also having at least one aperture therethrough;

an exterior front panel defined along one longitudinal edge by said front panel score line adjacent to said interior front panel, said exterior front panel defined along an opposite longitudinal edge by a front face edge score line, said exterior front panel having at least one aperture therethrough;

wherein said interior and said exterior front panels can be folded along said front panel score line and placed in a back to back vertical relationship;

a first and second vertically extending front panel tuck flap folded along a front face edge score line allowing said first and said second front panel tuck flaps to be inserted between said interior and exterior front panel;

a first vertically extending side panel perpendicular to said first front panel tuck flap and separated from said first tuck flap by said front face edge score line and further defined along a lateral side by a first side panel score line;

a second vertically extending side panel adjacent to said second front panel tuck flap and separated from said second tuck flap by said front face edge score line and further defined along a lateral side by a second side panel score line;

a center panel defined on opposing lateral edges by said first and said second side panel score lines extending along said first and said second vertically extending side panels, on a longitudinal edge said front face edge score line adjacent to said exterior front panel, and on an opposing longitudinal edge by a rear face edge score line adjacent to a lower box rear panel;

said center panel further having along said front face edge score line a first and a second front panel slot, wherein said first front panel slot receives said first front panel tab and said second front panel slot receives said second front panel tab;

a first vertically extending rear tuck flap which folds along said rear face edge score line and which is perpendicular to said first side panel, said first rear tuck flap further having a first rear panel slot adjacent to said rear face edge score line;

a second vertically extending rear tuck flap which folds along said rear face edge score line and which is perpendicular to said second side panel, said second rear tuck flap further having a second rear panel slot adjacent to said rear face edge score line;

wherein said lower box rear panel has first and second rear panel tab formed along opposite lateral edges, said rear panel separated from said first rear panel tab by a first rear panel tab score line, said rear panel separated from said second rear panel tab by a second rear panel tab score line, said lower box rear panel further having a rear panel anchor slot, said first and said second rear panel tabs removably received in said first and second rear panel slots formed in said first and second rear panel tuck flaps;

said storage box lid comprised of:

a vertically extending interior lid front panel defined by a front panel lower edge score line along one longitudinal edge and having along the opposite longitudinal edge a first and a second lid front panel tab;

a vertically extending exterior lid front panel defined along one longitudinal edge by said front panel lower edge score line adjacent to said interior lid front panel and along the opposite longitudinal edge by a front panel upper edge score line;

a first and a second lid front panel tuck flap adjacent to and foldable about said front panel upper edge score line;

a lid front panel defined along one longitudinal edge by said front panel edge score line, first front panel side edge score line along one lateral edge, second front panel side edge score line along the opposite lateral edge, and from panel score line along the opposite longitudinal edge;

said lid front panel having a first and a second lid front panel slot formed along said longitudinal edge formed by said front panel upper edge score line;

a vertically extending first lid front panel side member defined along one lateral edge by said first front panel side edge score line and along one longitudinal edge by said front panel upper edge score line;

a vertically extending second lid front panel side member defined along one lateral edge by said second front panel side edge score line and along one longitudinal edge by said front panel upper edge score line;

a lid center panel defined along one longitudinal edge by said front panel score line, along the opposite longitudinal edge by a rear panel score line, along one lateral edge by a first lid center panel edge and along the opposite lateral edge by a second lid center panel edge;

a lid rear panel defined along one longitudinal edge by said rear panel score line adjacent to said lid center panel, along the opposite longitudinal edge by a rear panel upper edge score line, along one lateral edge by a first rear panel side edge score line and a first lid rear panel edge, and along the opposite lateral edge by a second rear panel side edge score line and a second lid rear panel edge, said lid rear panel having a first and a second lid rear panel slot formed along said rear panel upper edge score line;

a first vertically extending rear panel side member defined along one lateral side by said first rear panel side edge score line adjacent to said lid rear panel and along one longitudinal edge by said rear panel upper edge score line;

a second vertically extending rear panel side member defined along one lateral side by said second rear panel side edge score line adjacent to said lid rear panel and along one longitudinal edge by said rear panel upper edge score line;

a vertically extending exterior rear panel face defined along one longitudinal edge by said rear panel upper edge score line adjacent to said lid rear panel and along the opposite longitudinal edge by a rear panel lower edge score line;

a vertically extending interior rear panel face defined along one longitudinal edge by said rear panel lower edge score line adjacent to said exterior rear panel face and having along the opposite longitudinal edge a first and a second rear panel tab respectively insertable into said first and said second rear panel slot;

a lid panel anchor tab centrally formed within said interior rear panel face and affixed to said storage box lid along said rear panel lower edge score line;

whereby said lid panel anchor tab is insertable into said rear panel anchor slot formed in said rear panel of said lower rectangular storage box;

a vertically extending first lid rear panel tuck flap defined along one longitudinal edge by said rear panel upper edge score line and perpendicular to said first lid rear panel side member;

a vertically extending second lid rear panel tuck flap defined along one longitudinal edge by said rear panel upper edge score line and perpendicular to said second lid rear panel side member;

whereby said first and said second lid rear panel tuck flap are insertable between said interior and said exterior rear panel face when said interior and exterior rear panel face are in back to back vertical relationship.

* * * * *